US010092081B2

(12) United States Patent
Burditt, Jr. et al.

(10) Patent No.: US 10,092,081 B2
(45) Date of Patent: Oct. 9, 2018

(54) REVOLVING COMPACT

(71) Applicant: HCT Group Holdings Limited, Central (HK)

(72) Inventors: Stephen Charles Burditt, Jr., Los Angeles, CA (US); Kamaal Washington, Los Angeles, CA (US)

(73) Assignee: HCT GROUP HOLDINGS LIMITED (HK)

( * ) Notice: Subject to any disclaimer, the term of this patent is extended or adjusted under 35 U.S.C. 154(b) by 28 days.

(21) Appl. No.: 15/206,027

(22) Filed: Jul. 8, 2016

(65) Prior Publication Data

US 2017/0007004 A1 Jan. 12, 2017

Related U.S. Application Data

(60) Provisional application No. 62/191,251, filed on Jul. 10, 2015.

(51) Int. Cl.

| | |
|---|---|
| ***B65D 43/14*** | (2006.01) |
| ***A45D 40/22*** | (2006.01) |
| ***A45D 33/00*** | (2006.01) |

(52) U.S. Cl.

CPC ..... *A45D 40/222* (2013.01); *A45D 33/008* (2013.01); *A45D 2040/225* (2013.01)

(58) Field of Classification Search

CPC .. A45D 40/22–40/222; A45D 33/006–33/008; A45D 2040/223–2040/228

USPC ..... 220/817–824, 244, 263, 283, 810, 220/836–843, 845–848

See application file for complete search history.

(56) References Cited

U.S. PATENT DOCUMENTS

| | | | |
|---|---|---|---|
| D35,976 | S | 9/1902 | McCormick |
| 1,527,052 | A | 2/1925 | McAndrews |
| 1,748,491 | A | 2/1930 | May |
| D83,668 | S | 3/1931 | Shebinin |
| D94,984 | S | 3/1935 | Noble |

(Continued)

FOREIGN PATENT DOCUMENTS

| | | | |
|---|---|---|---|
| EP | 2471406 | A1 | 7/2012 |
| FR | 2763811 | A1 | 12/1998 |

(Continued)

OTHER PUBLICATIONS

Freitas, Jr., Nanomedicine, Images, Foresight Institute, 1 page, Feb. 11, 2001.

(Continued)

*Primary Examiner* — Kareen Thomas

(74) *Attorney, Agent, or Firm* — Seager, Tufte & Wickhem LLP

(57) ABSTRACT

Compacts designed to hold a product and having a lid, and upper housing portion, and a lower housing portion. The upper housing portion and the lower housing portion are twistable relative to one another, with the lid secured to the upper housing portion and twisting therewith. The lid and lower housing portion comprise engaging structures to secure the lid in a closed position when the respective engaging structures are aligned with one another. When the upper housing portion and lid are twisted relative to the lower housing portion, the lid is free to open upon reaching a sufficient amount of twisting movement.

20 Claims, 7 Drawing Sheets

(56) References Cited

U.S. PATENT DOCUMENTS

D139,903 S 1/1945 Baff
3,130,433 A 4/1964 John
3,476,123 A 11/1969 Flax
3,886,618 A 6/1975 Paoletti
4,165,755 A 8/1979 Cassai
D268,292 S 3/1983 Chevassus
D269,067 S 5/1983 Ballereaud
4,421,127 A 12/1983 Geer
D281,731 S 12/1985 Phu
D293,612 S 1/1988 Bulwik
D293,944 S 1/1988 Trabattoni
D301,771 S 6/1989 Bakic
5,005,697 A 4/1991 Jimbo et al.
D316,763 S 5/1991 Ferrari
5,353,818 A 10/1994 Suzuki et al.
D353,100 S 12/1994 Mandel
D353,101 S 12/1994 Desgrippes
5,431,176 A 7/1995 Favre
D361,159 S 8/1995 Feng
D365,892 S 1/1996 Markham
5,603,340 A 2/1997 Gueret
5,655,553 A 8/1997 Giese et al.
D386,972 S 12/1997 Stoecker
5,709,232 A * 1/1998 Sheffler ..... A45D 33/006 132/295
5,713,471 A 2/1998 Gueret
5,813,420 A 9/1998 Sussman
5,839,626 A 11/1998 Gross et al.
D405,013 S 2/1999 Schaeffer
5,875,795 A 3/1999 Bouix
5,896,866 A 4/1999 Quennessen
5,976,616 A 11/1999 Wayne
D422,120 S 3/2000 Orsomando
D425,794 S 5/2000 Grossnickle
6,059,474 A 5/2000 Huang
6,070,749 A * 6/2000 Joulia ..... A45D 40/221 132/294
D428,209 S 7/2000 Kudo et al.
6,119,891 A 9/2000 Favre
D432,724 S 10/2000 Gavin
6,138,686 A 10/2000 Yuhara
D434,875 S 12/2000 Gavin
6,173,719 B1 1/2001 Petit
D439,019 S 3/2001 Motosko
D439,376 S 3/2001 Lerolle et al.
6,202,902 B1 3/2001 Starr
D442,868 S 5/2001 Gavin
6,240,930 B1 * 6/2001 Yuhara ..... A45C 13/008 132/293
6,315,479 B1 11/2001 Sakurai
6,336,460 B2 1/2002 Yuhara
6,354,308 B1 3/2002 Kuk
D457,687 S 5/2002 Millar
D457,986 S 5/2002 Rodriguez et al.
D468,058 S 12/2002 Thorpe
D471,108 S 3/2003 Calderone, Jr.
D479,630 S 9/2003 Lai
D481,319 S 10/2003 Orsomando
D485,018 S 1/2004 Beilman
D487,703 S 3/2004 Orsomando
D498,024 S 11/2004 Leppla et al.
D498,146 S 11/2004 Densky et al.
D498,422 S 11/2004 Theunynck
D503,245 S 3/2005 Vanoncini
D505,518 S 5/2005 Benjamin et al.
D507,078 S 7/2005 Greenfield
D513,873 S 1/2006 Bochno et al.
6,997,321 B2 2/2006 Young
D532,936 S 11/2006 Bakic
D535,104 S 1/2007 Chen
D535,441 S 1/2007 Maddy
7,172,357 B2 2/2007 Gueret
D539,481 S 3/2007 Lui
7,240,402 B2 7/2007 Suzuki et al.
D551,987 S 10/2007 Kuethe et al.
D554,292 S 10/2007 Thorpe
D554,293 S 10/2007 Thorpe
D554,294 S 10/2007 Thorpe
D554,804 S 11/2007 Bernard
7,334,685 B2 2/2008 Mathiez
D564,707 S 3/2008 Barresi
7,337,787 B2 3/2008 Matsuoka
D566,899 S 4/2008 De Baschmakoff
D576,354 S 9/2008 Dominski et al.
D576,770 S 9/2008 Mascotte et al.
D581,597 S 11/2008 Martinez
D586,504 S 2/2009 Moon
7,494,030 B2 2/2009 Bennett
D592,956 S 5/2009 Thiellier
D595,900 S 7/2009 Yamamoto
D600,857 S 9/2009 Maddy et al.
7,614,405 B2 11/2009 Allen et al.
D611,657 S 3/2010 Maddy et al.
D616,608 S 5/2010 Maddy
D626,289 S 10/2010 Lee
7,828,000 B2 11/2010 Lee
7,832,564 B2 11/2010 Kim
D633,653 S 3/2011 Lee
D642,333 S 7/2011 Praster
D645,617 S 9/2011 Mahdavi
D655,046 S 2/2012 Nakamura
D656,824 S 4/2012 Haile
D663,483 S 7/2012 Lee
D666,773 S 9/2012 Greenfield
D678,074 S 3/2013 De France
D679,604 S 4/2013 Sung
8,464,731 B1 * 6/2013 Eberlein ..... A45D 40/221 132/301
D688,420 S 8/2013 Lai
D693,059 S 11/2013 Tani
8,590,545 B2 11/2013 Won
D696,816 S 12/2013 Kordulla et al.
D698,256 S 1/2014 Thompson
D705,074 S 5/2014 Della Valle
D705,663 S 5/2014 Guichot
8,789,540 B2 * 7/2014 Lee ..... A45C 13/008 132/293
D714,157 S 9/2014 Albertini
D715,653 S 10/2014 Lavigne et al.
D716,148 S 10/2014 DeMarco et al.
D723,220 S 2/2015 Guor
D728,860 S 5/2015 Blanch
D743,101 S 11/2015 Pires et al.
9,220,332 B1 * 12/2015 DeVito ..... A45D 33/006
2002/0096185 A1 7/2002 Givens
2002/0162565 A1 11/2002 Sebban
2004/0206370 A1 10/2004 Byun
2006/0027481 A1 2/2006 Gelardi et al.
2006/0072956 A1 4/2006 Tanaka et al.
2006/0118454 A1 6/2006 Kang, III
2007/0029226 A1 2/2007 Yuhara et al.
2007/0131240 A1 6/2007 Prague
2007/0235056 A1 10/2007 Vintimiglia et al.
2008/0023023 A1 1/2008 Boye et al.
2008/0302384 A1 12/2008 Parker
2009/0272399 A1 11/2009 Kim, II
2009/0288677 A1 11/2009 Chen
2009/0293902 A1 12/2009 Ramos
2009/0320874 A1 12/2009 Boye et al.
2010/0031971 A1 2/2010 Ha
2010/0215422 A1 8/2010 Carroll et al.
2010/0288299 A1 11/2010 Won
2010/0307530 A1 12/2010 Bennett
2011/0176854 A1 7/2011 Nobles
2011/0266297 A1 11/2011 Thorpe et al.
2012/0136748 A1 5/2012 Shasteen et al.
2012/0266907 A1 10/2012 Chan
2012/0305442 A1 12/2012 Apodaca et al.
2013/0004226 A1 1/2013 Breidenbach et al.
2013/0051894 A1 2/2013 Lim et al.
2013/0284202 A1 10/2013 Limongi et al.
2014/0014659 A1 1/2014 Thorpe et al.
2014/0023689 A1 1/2014 Kim et al.
2014/0154295 A1 6/2014 Sim et al.

(56) References Cited

U.S. PATENT DOCUMENTS

FOREIGN PATENT DOCUMENTS

| | | | |
|---|---|---|---|
| FR | 2806272 | A1 | 9/2001 |
| FR | 2806893 | A1 | 10/2001 |
| JP | 5945015 | U | 3/1984 |
| JP | 2533414 | Y2 | 4/1997 |
| KR | 200409415 | Y1 | 2/2006 |
| KR | 100913110 | B1 | 8/2009 |
| KR | 1020130083521 | A | 7/2013 |
| WO | 2008010628 | A1 | 1/2008 |

OTHER PUBLICATIONS

Hobson, "Mechanical Iris Will Make You Want a Laser Cutter Even More", <<http://hackaday.com/2014/03/24/mechanical-iris-will-make-you-want-a-laser-cutter-even-more/>>, 10 pages, Mar. 24, 2014.

Lorac Pro Cream Eyeliner + Brush: Eyeliner, retrieved on May 29, 2013, at <<http://www.sephora.com/pro-creamey-eliner-brush-P374705?skuId=1432400>> 4 pages.

Nest-filler, retrieved on May 5, 2010 at <<http://www.nest-filler.com/cosmetics/view.htm?pageno=&bimil=&searchword=&idx=1328&cate1=1220334097&cate1_1=&cate2=&cate3=>>1 page.

Sephora Collection, Pitch Black All-In-1 Waterproof Eye Liner, retrieved on May 29, 2013 <<http://www.sephora.com/pitch-black-all-in-1-waterproof-eye-liner-P377198?skuId=1479070>> 4 pages.

International Search Report and Written Opinion, PCT/US2016/041647, dated Sep. 12, 2016.

* cited by examiner

REVOLVING COMPACT

CROSS REFERENCE TO RELATED APPLICATIONS

The present application claims the benefit of and priority to U.S. Provisional Patent Application Ser. No. 62/191,251, filed on Jul. 10, 2015, titled REVOLVING COMPACT, the disclosure of which is incorporated herein by reference.

FIELD

The present application relates to the field of cosmetic containers, more particularly to the design and functionality of cosmetic compacts.

BACKGROUND

Various compacts are known in the art for containing and allowing convenient access for a user. Some such products are also airtight to protect volatile products and keep fine powders and the like from creating a mess. New and alternative approaches to such devices are desired.

Overview

In an illustrative example, a compact is provided which is designed to hold a product in a generally central portion thereof and having a lid, and upper housing portion, and a lower housing portion. The upper housing portion and the lower housing portion are twistable relative to one another, with the lid secured to the upper housing portion and twisting therewith. When the upper housing portion and lid are twisted relative to the lower housing portion, the lid is released from being held in a closed position. In one illustrative example, the lower housing portion includes posts or clips which are configure to engage slots in the lid, with twisting motion misaligning the clips from the slots allowing automatic opening of the lid. In another illustrative example, the lid includes one or more tabs that extend downward to engage one or more posts in the lower housing portion when the lid is closed, with the alignment of the one or more posts and the one or more tabs allowing a twisting motion to cause disengagement, allowing the lid to open.

The compact may be an airtight compact. The lid may include a mirror on an interior side thereof. The twisting motion may take place against a spring tensioner. The lid may include a spring hinge which provides automatic opening action, or it may allow manual opening/closing without the spring hinge. The lid may be urged open a small amount using a structure, such as a ramped or angled post on the lower housing portion.

A first non-limiting example takes the form of a compact for containing a cosmetic product comprising: a lid having a hinge; an upper housing portion; and a lower housing portion twistable relative to the lid and upper housing portion; wherein the lid is configured to be released from being held in a closed position by twisting movement of the lower housing portion relative to the lid and upper housing portion.

A second non-limiting example takes the form of a compact as in the first non-limiting example, wherein the lid is configured to automatically open using a spring hinge upon reaching a sufficient amount of twisting movement. In an alternative, the lid may be pushed open by a ramp on the lower housing portion as a twisting motion continues past a point of release.

A third-non-limiting example takes the form of a compact as in any preceding non-limiting example, wherein the lower housing portion includes one or more posts which are configured to engage one or more corresponding structures of the lid to secure the lid in a closed position when the one or more posts are aligned with the one or more corresponding structures of the lid.

A fourth non-limiting example takes the form of a compact as in the third non-limiting example, wherein the upper housing portion and lower housing portion are configured to twist relative to one another such that the one or more posts of the lower housing portion become misaligned with corresponding structures in the lid, allowing opening of the lid by action of the spring in the lid hinge.

A fifth non-limiting example takes the form of a compact as in the third non-limiting example, wherein a spring is coupled to each of the lower housing portion and the upper housing portion to provide resistance against twisting and bias the lower housing portion, relative to the upper housing portion and lid, in a position where the posts and corresponding structure of the lid are aligned relative to one another to secure the lid in the closed position.

A sixth non-limiting example takes the form of a compact as in the third non-limiting example, wherein the one or more corresponding structures of the lid each comprise one or more tabs having a ridge thereon to engage the one or more posts of the lower housing portion.

A seventh non-limiting example takes the form of a compact as in the third non-limiting example, wherein the one or more corresponding structures of the lid each comprise one or more slots configured to engage the one or more posts of the lower housing portion.

An eighth non-limiting example takes the form of a compact as in any of the preceding non-limiting examples, wherein the lid is configured with a gasket and the upper housing is configured to mate with the gasket to provide an airtight container when the lid is closed.

A ninth non-limiting example takes the form of a compact as in any of the preceding non-limiting examples, wherein the lid comprises a mirror on an interior side thereof.

A tenth non-limiting example takes the form of a compact as in any of the preceding non-limiting examples, wherein a spring is coupled to each of the lower housing portion and the upper housing portion to provide resistance against twisting, to maintain a default position in which the posts or clips of the lower housing portion are aligned with the slots in the lid.

An eleventh non-limiting example takes the form of a compact as in the tenth non-limiting example, wherein the lower housing portion further comprises a spring guide to hold the spring in place.

A twelfth non-limiting example takes the form of a compact as in any of the preceding non-limiting examples, wherein the upper housing portion comprises a downward extending post, and the lower housing portion comprises an upward extending cylinder that receives the downward extending post of the upper housing portion.

A thirteenth non-limiting example takes the form of a compact as in any of the preceding non-limiting examples, wherein the lid hinge is secured to the upper housing portion such that the lid and upper housing move together when being twisted relative to the lower housing portion, and the lid is configured to open relative to each of the lower and upper housing portions.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
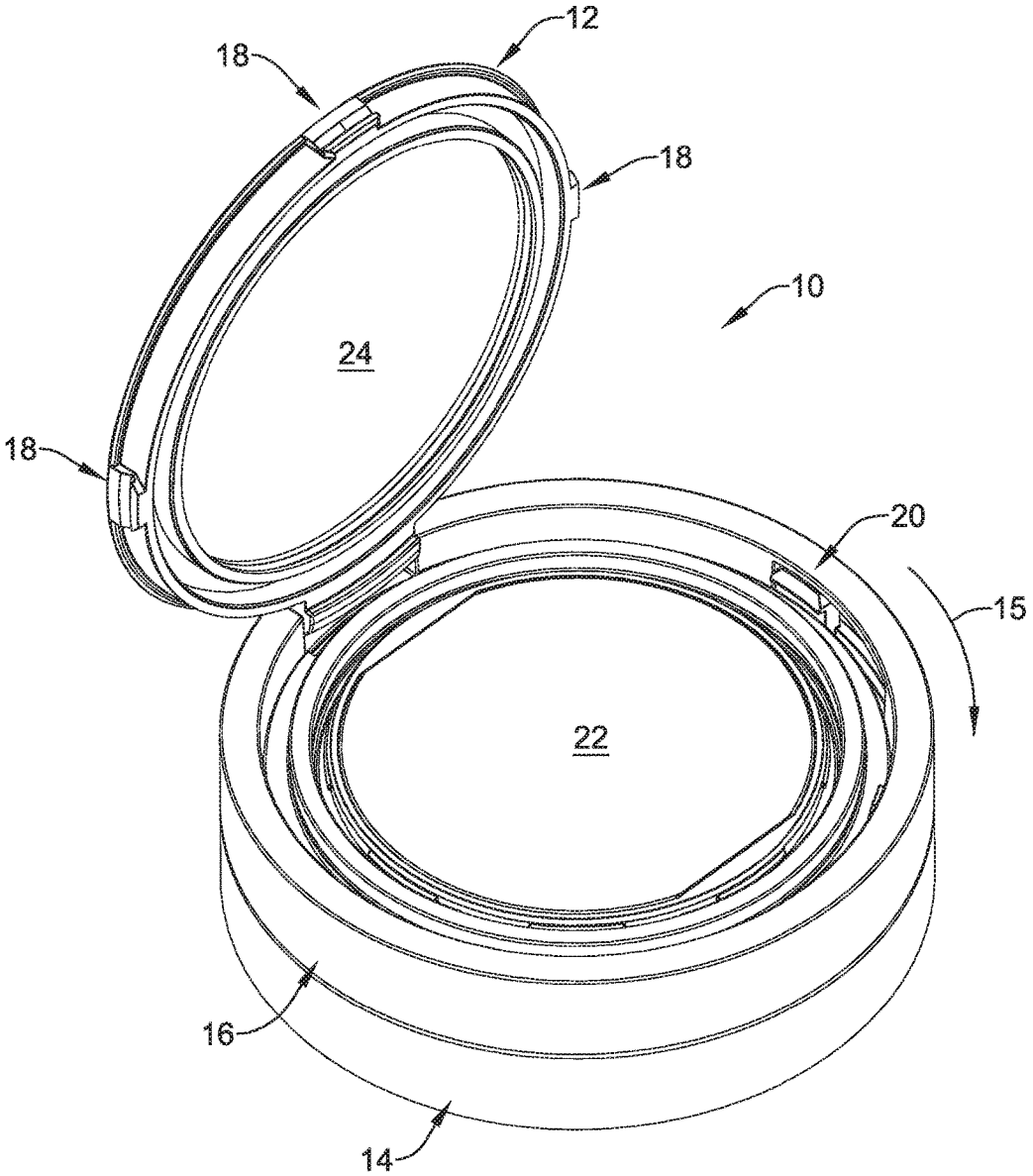
FIG. 1 is a perspective view of an illustrative compact.

FIG. 1 is a perspective view of an illustrative compact. The compact 10 includes a lid 12, a lower housing portion 14, and an upper housing portion 16. The lower housing portion 14 may be twisted relative to the upper housing portion 16 and lid 12, as shown at arrow 15. The lid 12 includes one or more slots or tabs 18 which are adapted to engage with corresponding post(s) 20 that form part of or are attached to the lower housing portion 14. In this example, tabs are shown at 18; slots may be used instead.

When the slots or tabs 18 are engaged with the corresponding posts 20, the lid 12 is latched shut. Twisting motion 15 allows the tabs to be disengaged from the posts 20, allowing the compact to be opened.

A quantity of product 22 may be carried in the compact 12; a single "puck" of product is shown but those skilled in the art will recognize that multiple compartments may be provided instead. For example, the product may include two halves with a separator, pie shaped pieces, or other designs. A mirror 24 may optionally be provided on the interior side of the lid 12.

As noted, the lower housing portion 14 can be twisted 15 relative to the upper housing portion 16. Doing so will misalign the posts 20 relative to the slots or tabs 18 of the lid 12. Once twisted far enough, the posts 20 and slots or tabs 18 will become disengaged, allowing the lid to open. In some examples, the lid 12 may open manually, that is, without assistance of a spring or biasing member. In other examples, a spring hinge automatically opens lid 12 once the slots or tabs 18 disengage from their corresponding posts 20. The twisting action of the upper housing portion 16 may occur against spring tension applied by a spring contained in the lower housing portion 14.

Figure 2:
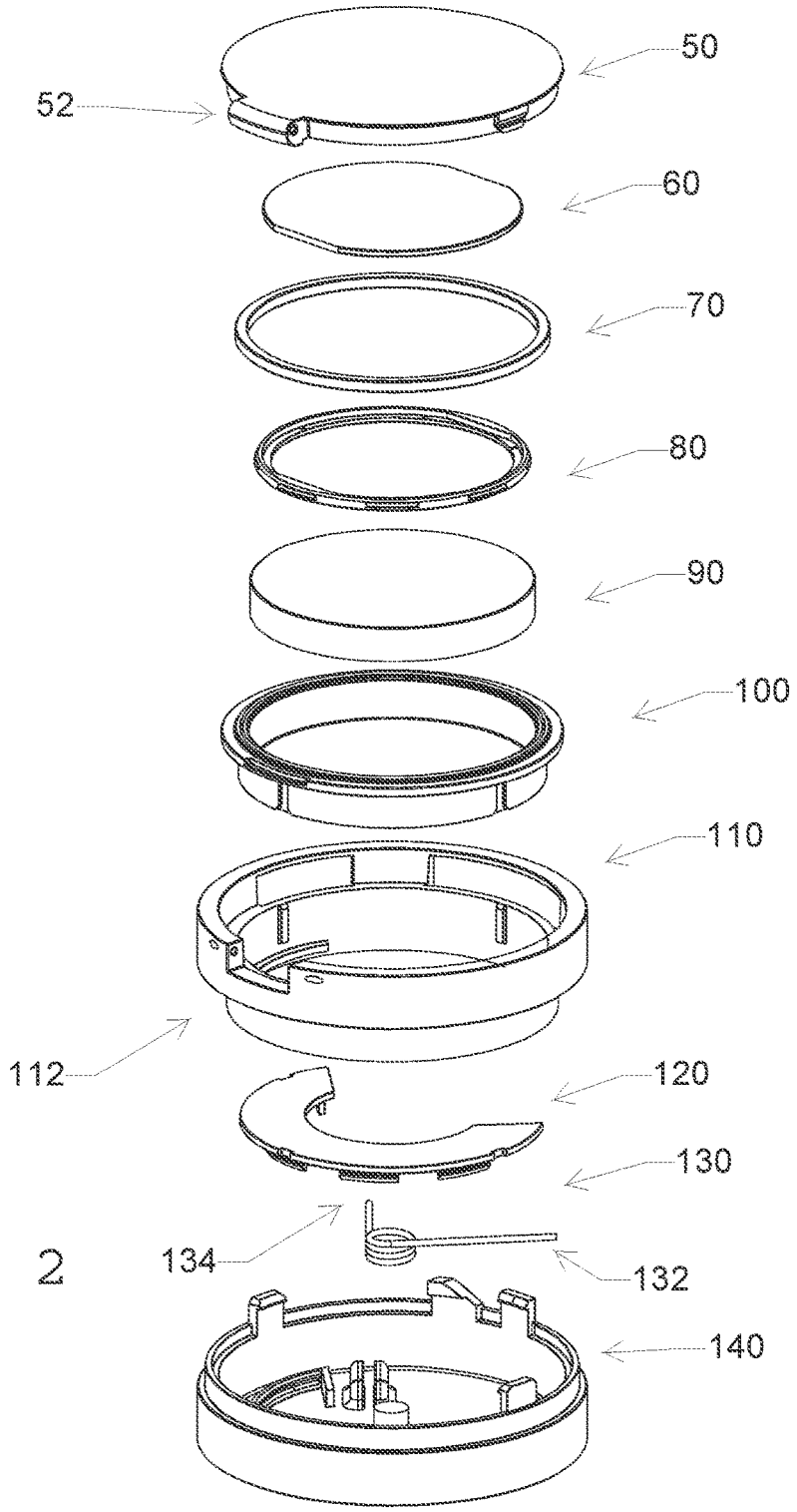
FIG. 2 is an exploded view of an illustrative compact.

FIG. 2 is an exploded view of an illustrative compact. Beginning at the top, the lid 50 is illustrated with its hinge 52 shown. The hinge 52 may be designed for manual opening, or may be spring loaded to open when not held closed. A mirror 60 is optionally provided as is a retainer ring 80 for the mirror, with the retainer ring 80 adapted to mate with a retainer ring channel or slots (not shown) in the lid 50.

A gasket 70 is shown. The gasket 70 is optional; for example, a compact that is not air tight may omit the gasket 70. For a sealed compact, the gasket 70 operates to provide an air tight seal, in cooperation with a base insert 100, which is provided to contain the product 90, which may be, for example, a puck of cosmetic product. Other implementations may include multiple compartments in the base insert 100 so that more than one product is contained in the compact.

Next is the upper housing portion 110, which includes a slot 112 in which the hinge 52 of the lid 50 may rest. The upper housing portion and the lid may be snap fit or adhesively bonded together, or connected together by other methods or mechanisms. For example, in the embodiment shown, small openings are located on either side of the slot 112 for entry of a pin to secure the hinge 52 to the upper housing portion 110.

The lower housing portion 140 is also shown, and has placed therein a spring 130 and spring guide 120. The spring guide 120 holds the spring in place 130 once assembled. The spring 130 includes a first end 132, which is "on top" in the Figure, and which during assembly is inserted in a slot on the upper housing portion 110 to hold it therein. The second end 134 of the spring 130 is engaged by the lower housing portion 140, such that the spring 130 is biased against the twisting motion that is needed to release the lid 50 from the hold of the posts (see FIG. 3) on the lower housing portion 140.

Figure 3:
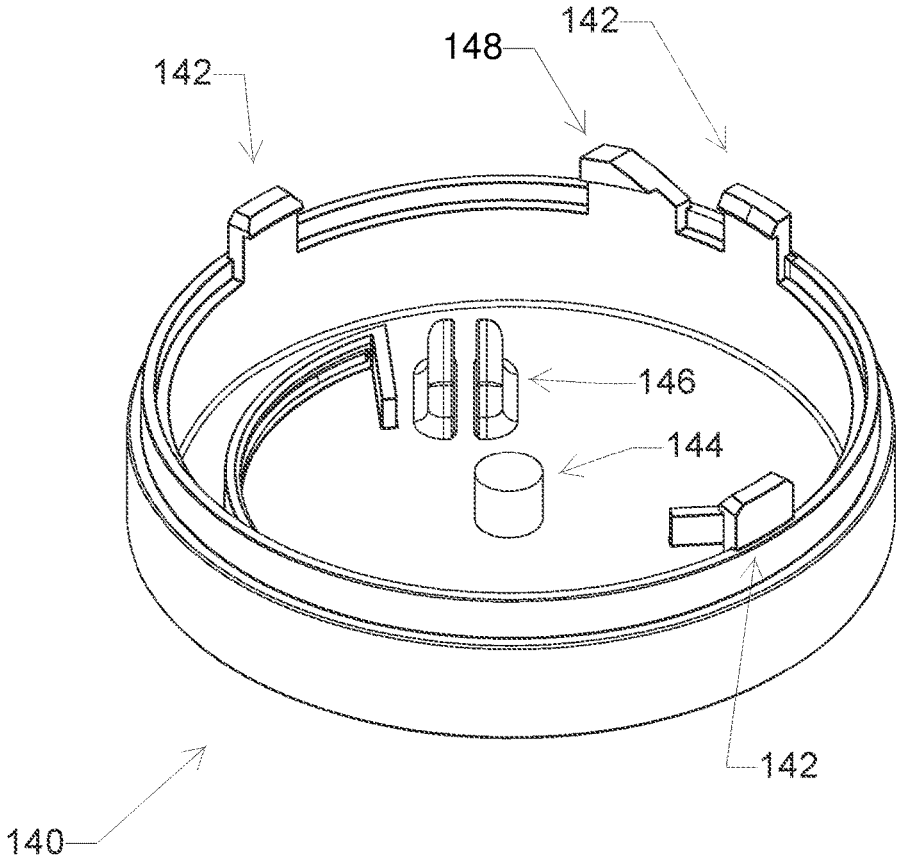
FIG. 3 shows details of the lower housing portion of the compact of FIG. 1.

FIG. 3 shows select details of the lower housing portion 140 of the compact of FIG. 2. The lower housing portion 140 includes posts 142 that are used as discussed relative to FIG. 1 to secure the lid in a closed configuration. For example, the posts 142 can engage tabs or slots provided in the lid; with the lid fully closed, twisting of the upper housing portion relative to lower housing portion 140 is used to engage or disengage the posts 142 from corresponding structures of the lid. The lower housing portion includes a post 144 to on which the spring 130 (FIG. 2) is placed, as well as a clip or slot 146 in which the second end 134 (FIG. 2) of the spring 130 (FIG. 2) is secured. An angled post 148 is also shown and may be included to force the lid opened as it is twisted beyond the point of being released from being held closed by posts 142.

Figure 4:
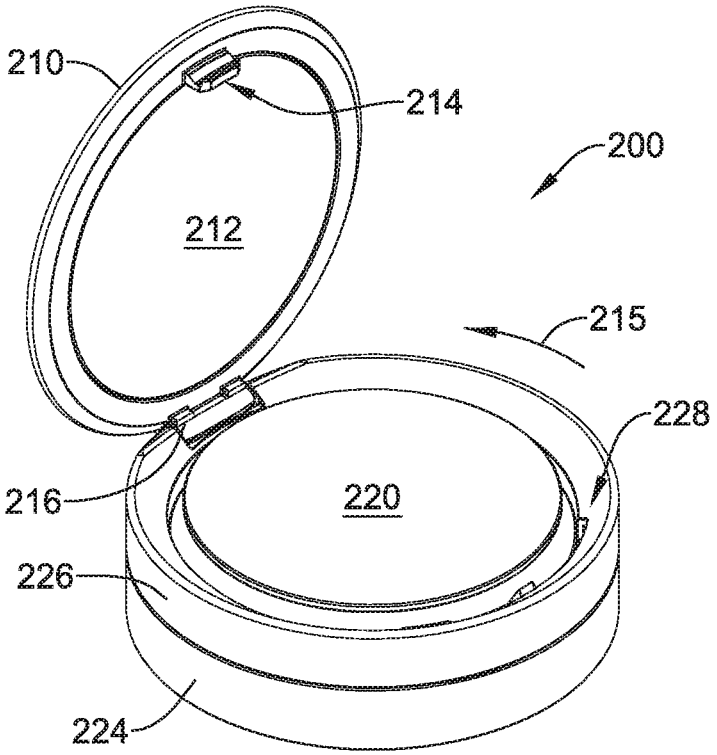
FIG. 4 is a perspective view of another illustrative compact.

FIGS. 4-7 show another illustrative embodiment, this time with fewer components included in the design. FIG. 4 shows the compact 200 as including a lid 210, having an optional mirror 212 and an engaging structure in the form of a tab 214 that is adapted to engage with a corresponding structure in the lower housing portion 224. One tab 214 is shown; any suitable number of tabs 214 may be provided if desired. An upper housing portion 226 is also shown, with the lid 210 including a hinge 216 secured to the upper housing portion 226. The hinge 216 may include a spring, or it may allow for manual opening of the lid 210.

The upper and lower housing portions 224, 226 support and generally contain product 220, shown as a puck of product; other product structure or format may be used including, for example, a sectioned product having several different colors or product types available to the user. The upper housing portion 226 includes a slot that allows the tab 214 to engage the engaging structures of the lower housing portion 224.

Figure 5:
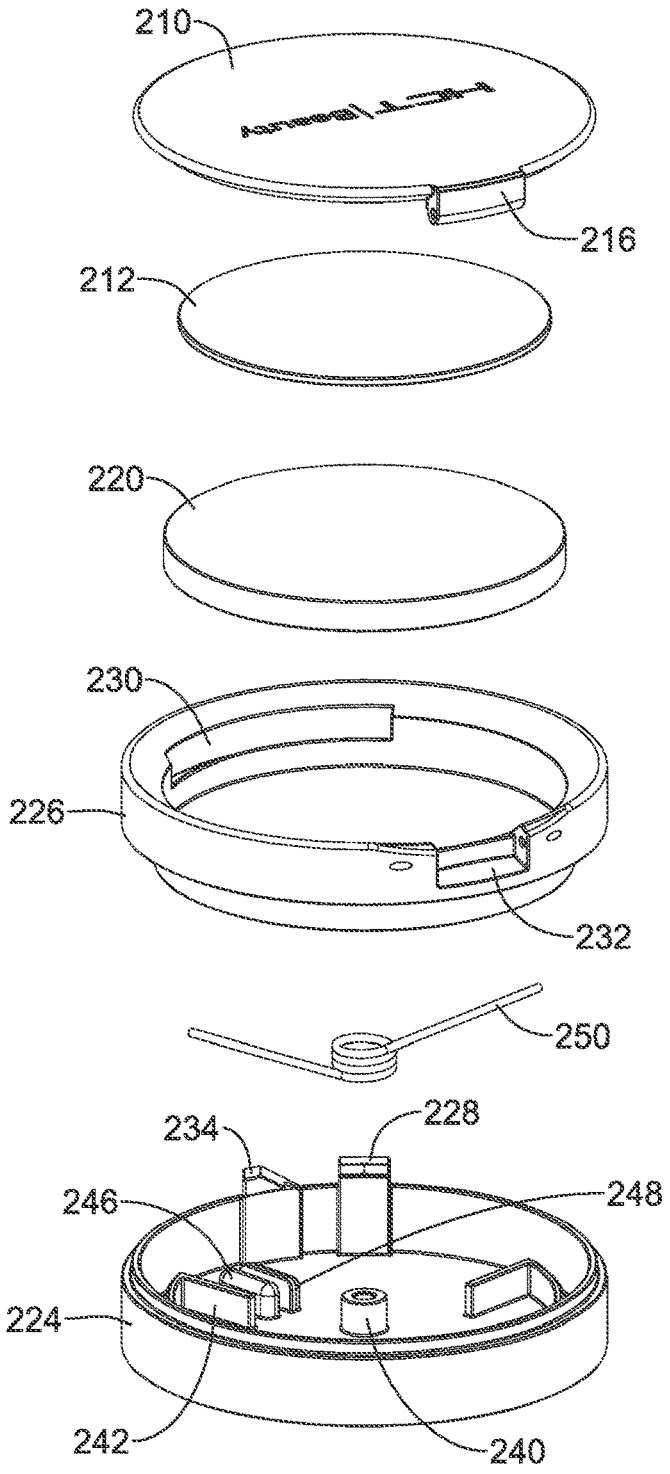
FIG. 5 is an exploded view of the illustrative compact of FIG. 4.

FIG. 5 shows further details of the embodiment of FIG. 4 with an exploded view. As can be seen, in this embodiment, fewer parts are used than in that of FIG. 1-3. The lid 210, with hinge 216, may optionally have a mirror 212 secured thereto using, for example, snap fit or adhesive or a combination thereof. A product puck 220 is shown for illustrative purposes.

The upper housing portion 226 is shown with a slot at 230 to allow engagement of the lid 210 and engaging structure(s) (not shown) thereof, to the lower housing portion 224. For example, here, an engaging post 228 is shown in the lower housing portion 224, in alignment with the slot 230, to allow engagement to the lid 210.

Another slot is shown at 232 on the upper housing portion 226 for receiving the hinge 216 of lid 210. Openings are shown on either side of slot 232 to allow a pin to be placed to secure the hinge 216 and lid 210 to the upper housing portion. Snap fit or any other suitable mechanism may be used instead. When a twisting movement 215 is effected on the upper housing portion 226 relative to the lower housing portion 224, the lid moves with the upper housing portion 226. The hinge 216 may be spring loaded to automatically open upon release of the lid relative to the lower housing portion, or it may simply allow manual opening.

Figure 6:
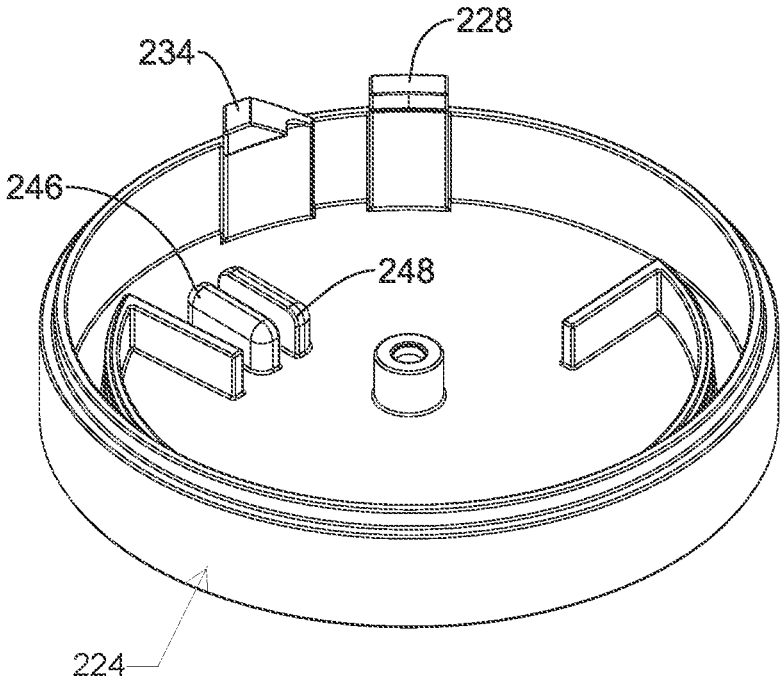
FIG. 6 shows details of the lower housing portion of the compact of FIG. 4.

The lower housing portion 224 is shown with additional detail in FIG. 6. The engaging post 228 extends upward therefrom, as does an angled tab 234. The angled tab 234 forces the lid 210 to start opening in response to twisting beyond a release point where the tab (not shown) of the lid 210 becomes disengaged from the engaging post 228 of the lower housing portion. For manual opening, the angled tab 234 may cause opening by a few millimeters to allow a user to access the edge of the lid 210 with a fingernail, for example. The engaging post may, for example, have a ledge facing downward thereon to engage a corresponding engaging structure of the lid 210 such as a tab 214 as shown in FIG. 4.

Figure 7:
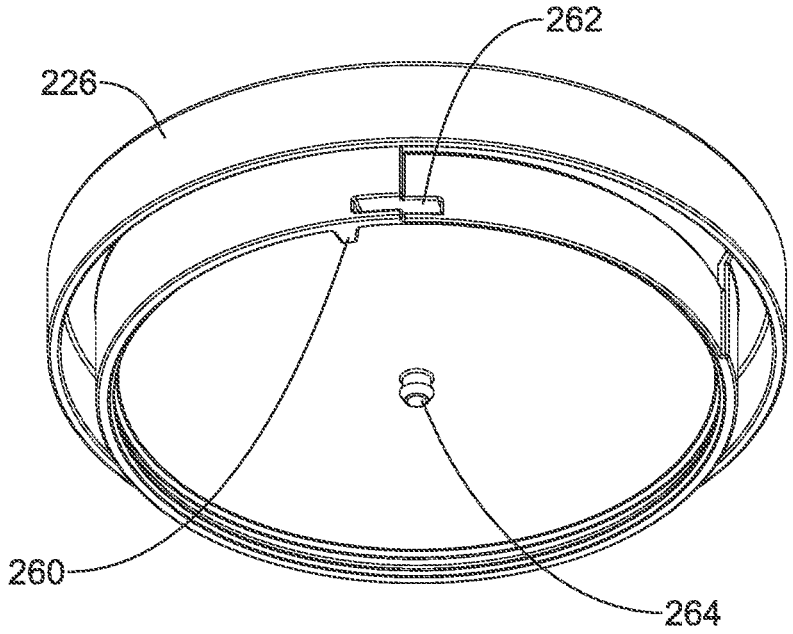
FIG. 7 shows select details of an upper housing portion of the compact of FIG. 4.

FIG. 7 illustrates some design details of the underside of the upper housing portion 226. As can be seen in this view, there is a centrally located post 264 used as outlined below. In addition, a stop 260 can be seen as well as a slot 262. The stop 260 can be used to engage a structure in the lower housing portion 224 to prevent twisting the upper housing portion 226 relative to the lower housing portion 224 in an undesired direction. The slot 262 can receive an end of the spring 250 (FIG. 5).

Referring to each of FIGS. 6 and 7, an upward extending cylindrical structure 240 with a hollowed center is shown in the center of the lower housing portion 224 in FIG. 6. This element 240 is used to facilitate smooth twisting relative to the upper housing portion 226 which, as shown below in FIG. 7, has a corresponding post 264 to engage element 240. Elements 240, 264 may be snap fit together if desired. A like combination of structures may also be used in the embodiment of FIGS. 1-3, by hollowing post 144 (FIG. 3) and providing a post on the bottom of the lower housing portion 110. In another example, the cylindrical structure 240 may not be hollowed and may be inserted into a hollowed cylinder that replaces post 264 of the upper housing portion 226.

Tabs 246, 248 (which may be referred to as posts instead, if desired) are sized and spaced to secure one end of the spring 250 (FIG. 5). In some examples, a spring guide is included as indicated in FIG. 3 above. Alternatively, as shown in the embodiment of FIGS. 4-7 the upper housing portion 226 may have a smooth lower surface that serves to keep the spring 250 (FIG. 5) suitably retained.

When fully assembled, the spring 250 biases the upper housing portion such that the engaging structure (tab 214 in FIG. 4) of the lid 210 is aligned with the engaging structure (post 228) of the base 224. The stop 260 arrests further movement upon reaching the fully aligned preferential position—that is, the stop 260 prevents the spring 250 from twisting the lower housing portion 224 beyond this engaged position relative to the upper housing portion. When the lid is closed and in the biased or preferential position caused by the spring 250, the respective engaging structures 214 and 228 keep the lid 210 in a secured, closed position. Twisting movement against the spring bias causes the engaging structures to become disengaged, and the lid 210 can then be opened.

A further illustrative example takes the form of a compact for containing a cosmetic product comprising: a lid having a hinge; an upper housing portion; and a lower housing portion twistable relative to the lid and upper housing portion; wherein: the lid comprises first engaging means (such as tabs 18 in FIG. 1, one or more slots in place of the tabs, or a tab 214 in FIG. 4); the lower housing portion comprises second engaging means (such as posts 142 in FIG. 3 or post 228 in FIGS. 5-6); such that the first engaging means is configured to secure the lid to the second engaging means, against pressure of the lid biasing means, when the lower housing portion and upper housing portion are aligned in a preferential alignment with the lid closed; and the lower housing portion comprises twist biasing means (such as spring 132 in FIG. 3 in combination with posts 146 in FIG. 3, or spring 250 in combination with posts or tabs 246, 248 in FIG. 5) to bias the lower housing portion into the preferential alignment with the upper housing position when the lid is open or closed, further wherein the upper housing portion and lower housing portion are twistable from the preferential alignment to a position of misalignment to disengage the first and second biasing means from one another and enable the lid biasing means to open the lid.

Additionally or alternatively, the further non-limiting example may be configured such that the lid hinge is secured to the upper housing portion such that the lid and upper housing move together when being twisted relative to the lower housing portion. The lid may, in a further embodiment, include lid biasing means (such as a hinge 52 in FIG. 2 or hinge 216 in FIG. 4) for biasing the lid in an open position Each of the above examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description.

The Abstract is provided to comply with 37 C.F.R. § 1.72(b), to allow the reader to quickly ascertain the nature of the technical disclosure. It is submitted with the understanding that it will not be used to interpret or limit the scope or meaning of the claims.

Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A compact for containing a cosmetic product comprising:

a lid having a lid hinge;

an upper housing portion; and a lower housing portion twistable relative to the lid and upper housing portion;

wherein the lid is configured open in response to twisting movement of the lower housing portion relative to the lid and upper housing portion; and wherein the lid hinge is secured to the upper housing portion such that the lid and upper housing portion move together when being twisted relative to the lower housing portion, and the lid is configured to open relative to each of the lower and upper housing portions.

2. The compact of claim 1 wherein the hinge comprises a hinge spring such that the lid is configured to automatically open upon reaching a sufficient amount of twisting movement.

3. The compact of claim 1 wherein the lower housing portion includes one or more posts which are configured to engage one or more corresponding structures of the lid to secure the lid in a closed position when the one or more posts are aligned with the one or more corresponding structures of the lid.

4. The compact of claim 3 wherein the upper and lower housing portions are configured to twist relative to one another such that the one or more posts of the lower housing portion become misaligned with corresponding structures in the lid, allowing the lid to open.

5. The compact of claim 3 wherein a spring is coupled to each of the lower housing portion and the upper housing portion to provide resistance against twisting and bias the lower housing portion, relative to the upper housing portion and lid, in a position where the posts and corresponding structure of the lid are aligned relative to one another to secure the lid in the closed position.

6. The compact of claim 3 wherein the one or more corresponding structures of the lid each comprise one or more tabs having a ridge thereon to engage the one or more posts of the lower housing portion.

7. The compact of claim 3 wherein the one or more corresponding structures of the lid each comprise one or more slots configured to engage the one or more posts of the lower housing portion.

8. The compact of claim 1 wherein the lid comprises a gasket, and the upper housing is configured to mate with the gasket to provide an airtight container when the lid is closed.

9. The compact of claim 1 wherein the lid comprises a mirror on an interior side thereof.

10. The compact of claim 1 wherein a spring is coupled to each of the upper and lower housing portions to provide resistance against twisting, to maintain a default position in which one or more posts or clips of the lower housing portion are aligned with one or more slots in the lid.

11. The compact of claim 10 wherein the lower housing portion further comprises a spring guide to hold the spring in place.

12. The compact of claim 10 wherein the upper housing portion comprises a downward extending post, and the lower housing portion comprises an upward extending cylinder that receives the downward extending post of the upper housing portion.

13. The compact of claim 1 wherein the lower housing portion comprises an angled post for urging the lid toward an open position as the lid and upper housing portion are twisted relative to the lower housing portion, and the lid hinge allows manual opening of the lid.

14. The compact of claim 3 wherein the one or more corresponding structures of the lid each comprise one or more tabs having a ridge thereon to engage the one or more posts of the lower housing portion.

15. The compact of claim 3 wherein the one or more corresponding structures of the lid each comprise one or more slots configured to engage the one or more posts of the lower housing portion.

16. A compact for containing a cosmetic product comprising:

a lid having a lid hinge;

an upper housing portion; and a lower housing portion twistable relative to the lid and upper housing portion; wherein:

the lid comprises first engaging means;

the lower housing portion comprises second engaging means;

such that the first engaging means is configured to secure the lid to the second engaging means, when the lower housing portion and upper housing portion are aligned in a preferential alignment with the lid closed; and the lower housing portion comprises twist biasing means to bias the lower housing portion into the preferential alignment with the upper housing position when the lid is open or closed, further wherein the upper housing portion and lower housing portion are twistable from the preferential alignment to a position of misalignment to disengage the first and second biasing means from one another and enable the lid to open.

17. The compact of claim 16 wherein the lid hinge is secured to the upper housing portion such that the lid and upper housing portion move together when twisted relative to the lower housing portion.

18. The compact of claim 16 wherein the lid hinge comprises lid biasing means for biasing the lid in an open position.

19. A compact for containing a cosmetic product comprising:

a lid having a hinge;

an upper housing portion; and a lower housing portion twistable relative to the lid and upper housing portion, the lower housing portion including one or more posts which are configured to engage one or more corresponding structures of the lid to secure the lid in a closed position when the one or more posts are aligned with the one or more corresponding structures of the lid; and wherein the upper and lower housing portions are configured to twist relative to one another such that the one or more posts of the lower housing portion become misaligned with corresponding structures in the lid, allowing the lid to open.

20. The compact of claim 19 wherein a spring is coupled to each of the lower housing portion and the upper housing portion to provide resistance against twisting and bias the lower housing portion, relative to the upper housing portion and lid, in a position where the posts and corresponding structure of the lid are aligned relative to one another to secure the lid in the closed position.

* * * * *